United States Patent [19]

Burch et al.

[11] 3,980,282

[45] Sept. 14, 1976

[54] MATERIAL MIXING APPARATUS

[75] Inventors: Elsward K. Burch, Chicago; Pete B. Pedersen, Glendale Heights, both of Ill.

[73] Assignee: Pettibone Corporation, Chicago, Ill.

[22] Filed: Mar. 18, 1974

[21] Appl. No.: 451,734

[52] U.S. Cl. ..... 259/168; 259/178 A

[51] Int. Cl.[2] ..... B01F 7/20; B28C 7/24

[58] Field of Search ..... 259/168, 145, 6, 7, 259/178 A

[56] References Cited

UNITED STATES PATENTS

| | | | |
|---|---|---|---|
| 2,270,628 | 1/1942 | Fitzgerald | 259/168 X |
| 2,367,149 | 1/1945 | Smith | 259/97 X |
| 2,831,418 | 4/1958 | Ponisch | 259/97 X |
| 3,256,573 | 6/1966 | Hunter | 259/168 X |
| 3,744,768 | 7/1973 | Kauffman | 259/168 X |
| 3,779,520 | 12/1973 | Edwards | 259/7 X |

FOREIGN PATENTS OR APPLICATIONS

| | | | |
|---|---|---|---|
| 1,815,212 | 11/1970 | Germany | 259/168 |
| 2,974 | 11/1909 | United Kingdom | 259/168 |

*Primary Examiner*—Peter Feldman
*Assistant Examiner*—Donald B. Massenberg
*Attorney, Agent, or Firm*—Norman H. Gerlach

[57] ABSTRACT

A material mixing apparatus having a cylindrical mixing bowl within which there is disposed a rotary, power-driven, mixing assembly embodying a cylindrical turret which embodies an upper extension and carries about its periphery a series of material mixing components including lift plows and material cutters. When the apparatus is used for mixing materials which combine and liberate heat because of the addition of water or other liquid, the added water or other liquid is applied to the turret and its extension for wash-down purposes in order to avoid the creation of indestructible solid lumps in the material undergoing mixing. A novel turret configuration and a novel plow and plow holder arrangement which accomplishes efficient material agitation and folding within the bowl, constitute the principal features of the present invention.

12 Claims, 8 Drawing Figures

10
12
14
16
22
24
25
26
28
30
32
33
34
35
36
38
40
42
44
46
48
54
56
58
60
62
64
71
90
92
94
96
98
100
102
104
106
108
110
111
112
114
116
120
122
124
126
130
132
134
135
136
137
138
139
140
142
144
146
147
148
150
152
154
156
200
M

MATERIAL MIXING APPARATUS

The improved material mixing apparatus comprising the present invention is designed for use primarily in connection with the mixing of sulphuric acid and water with dry lead oxide in order to produce a soft semi-solid compound which commonly is referred to as "battery paste" and is used as a filler for the negative and positive plates of automotive and other wet cell batteries. The invention is, however, capable of other uses and the mixing apparatus of the present invention is capable of use, with or without modification as required, for the mixing of a wide variety of materials regardless of whether such materials are capable of chemical union to produce a compound or whether they are incapable of chemical union so that when blended together they form simply a mixture. Exemplary of this latter use for the mixing apparatus of the present invention is the mixing of foodstuffs such as the ingredients which are used in the manufacture of confections such as candy bars or the like. Irrespective, however, of the particular use to which the present invention may be put, the essential features thereof are at all times preserved.

In the disclosure of the drawings and as well as in the description accompanying the same, the illustrated and described mixing apparatus is designed essentially for the production of battery paste wherein the principal ingredients which cooperate to make up such paste are dry lead oxide in granulated or powdered form, sulphuric acid and water. Heretofore, with a conventional or standard mixing apparatus which is essentially designed for the same purpose, numerous problems have arisen, principal among which is the formation of hard solids which are practically indestructible so that they not only contaminate the finished product, but also present a hazard to the moving plows and other mixing adjuncts within the bowl which encloses the material undergoing mixing. In the case of battery paste mixing operations, should the added sulphuric acid come into contact with the lead oxide while parts of it are still dry due to improper or inefficient water addition, undesirable solids will be formed or treated. Stated otherwise, the failure of conventional mixing apparatus to attain a uniform predetermined moisture condition throughout the lead oxide component of the mixture before the addition of sulphuric acid will result in the creation of the aforementioned undesirable hard lumps or solids.

Still another limitation that is attendant upon the construction and use of present-day material mixing apparatus resides in the fact that where rotary plow or other material displacing and mixing components within the bowl are provided, such components are so positioned and shaped that as they trail or follow each other, they cut the same swath around the bowl and, therefore, leave areas or regions which are not effectively acted upon by such components.

The requirement of an unduly long mixing cycle, the presence of small obstructions, either moving or stationary, on which dry oxide material may collect and give rise to a poor product, and the lack of a large physical mixing space within the bowl so as to insure the efficient treatment of a maximum size load for any given bowl diameter, constitute additional limitations that are attendant upon the construction and operation of a conventional or standard material mixing apparatus of the type that is designed for the same purpose as the particular mixing apparatus of the present invention.

The herein disclosed invention is designed to overcome the above-noted limitations that are attendant upon the construction and use of present-day material mixing apparatus and, toward this end, the invention contemplates the provision of a bowl-type mixing apparatus having a generally cylindrical mixing bowl and a coaxial rotary power-driven turret on which there are mounted plural lift plow components and other material moving components which sweep around the circumference of the bowl and, in so doing, exert their mixing influence on the material undergoing treatment. The lift plow components are of novel construction, firstly, in that they are not identical in size or shape so that neither plow component acts precisely in the same circumferential path as the other component. Secondly, each orbiting plow component, although different from the other plow component, functions in a novel manner to raise the relatively dry lead oxide material progressively from the lowermost region of the bowl and establish a trailing void immediately behind the raised material while at the same time, a sharply inclined surface triangular web which is formed on such plow component and is disposed in the path of oncoming water and granular material that are introduced into the bowl, raises such water and material and places them into the void water where they are then assimilated into the mass of relatively dry material in a uniform manner when such material falls by gravity and dissipates the void. More specifically, water is introduced into the bowl by a nozzle which directs the water against the side of the rotating turret so that such water serves to wash down the turret, so to speak, and prevent the collection of dry oxide thereon. The washed down oxide, thus largely encompassed by water is then thrown into the void and assimilated in the mass of material undergoing mixing as heretofore described.

At such time as the dry lead oxide material has thus been thoroughly wetted so that there is no danger of any residual dry oxide spots or regions, means are provided for the introduction of sulphuric acid over the surface of the thus moistened material undergoing treatment. Since the lead oxide is thoroughly wetted before the addition of sulphuric acid, such acid may be introduced with impunity and there will be no dry oxide which, otherwise, upon contact with the acid would create undesirable solids.

The provision of a material mixing apparatus such as has briefly been outlined above and possessing the stated advantages, constitutes the principal object of the invention.

The provision of a material mixing apparatus which is relatively simple in its construction and, therefore, may be manufactured at a low cost; one which is comprised of a minimum number of moving parts and, therefore, is unlikely to get out of order; one which is rugged and durable and will, therefore, withstand rough usage; one in which the turret for supporting the rotary plow and other material-mixing components is of small diameter and size with respect to the diameter of the bowl within which it rotates, thereby increasing the volume of the mixing annulus so that relatively large batches of material may be processed in an apparatus which is not unduly large; one in which the interior of the bowl, the exterior of the rotating turret, and the surfaces of the material-moving components are smooth so that there are no protruding elements or other devices or places where dry oxide or other material could be trapped, whether such devices be moving or stationary; one which is capable of ease of assembly and dismantlement for purposes of inspection, replacement or repair of parts; one which, otherwise, is well-adapted to perform the services required of it is characterized by extremely high efficiency, ease of cleaning and relatively short mixing time and is further characterized by such sensitivity to the physical properties being developed in the materials being mixed that the load sensed by the turret-driving means is indicative of the degree of the physical state of the mixing process as a whole so much so that such sensitivity may be utilized to automate and control the mixing process, are further desirable features which have been borne in mind in the production and development of the present invention.

Other objects and advantages of the invention, not at this time enumerated, will become readily apparent as the nature of the invention is better understood from a consideration of the following detailed description.

The invention consists in the several novel features which are hereinafter set forth and are more particularly defined by the claims at the conclusion hereof.

In the accompanying three sheets of drawings forming a part of this specification, one exemplary embodiment of the invention which is designed primarily, but not necessarily, for the mixing of dry lead oxide with sulphuric acid and water is shown.

Figures 1, 7, 8:
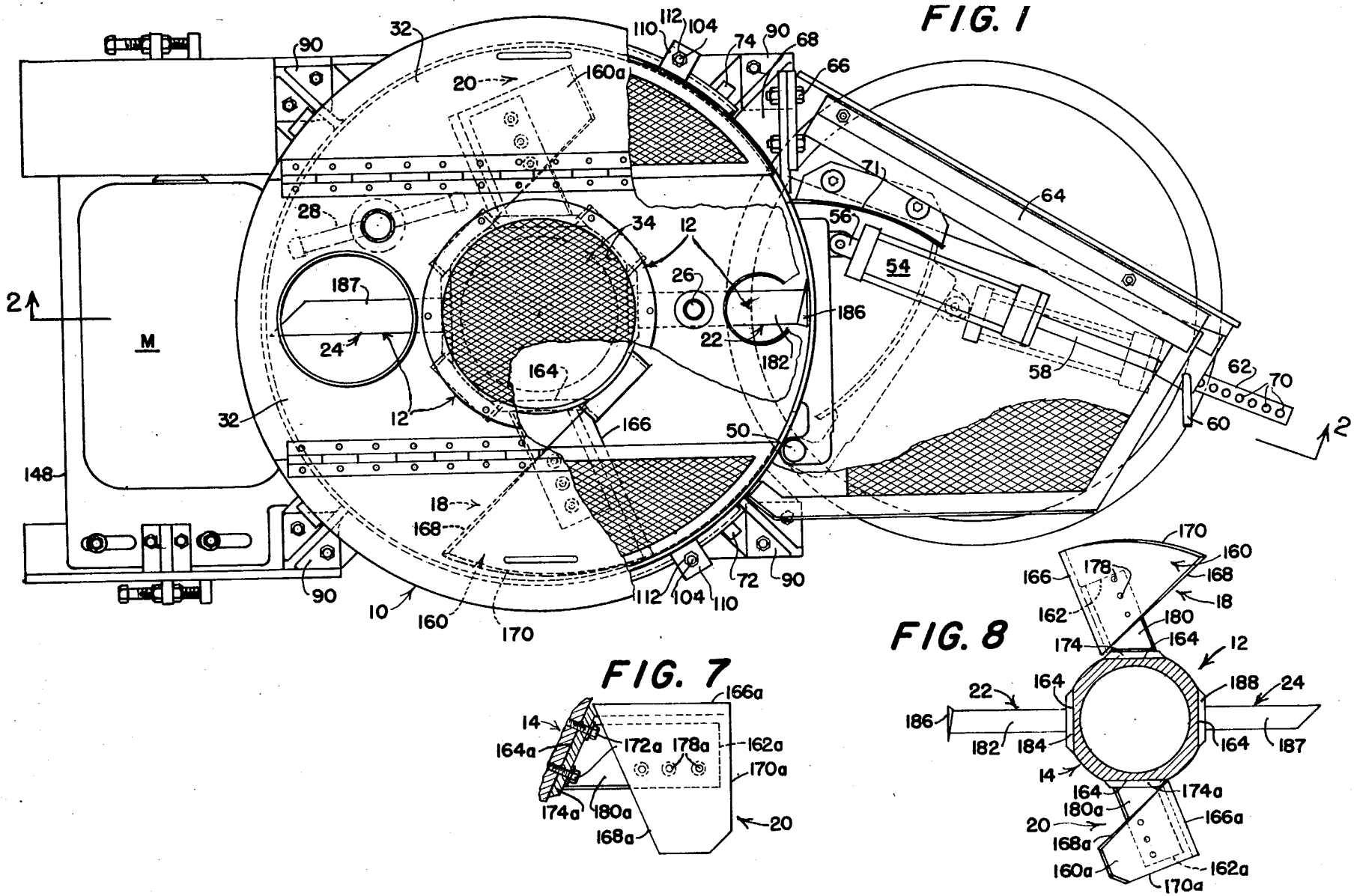
FIG. 1 is a top plan view of a material mixing apparatus which is constructed in accordance with the principles of the present invention, a portion of the cover plate of the bowl of the apparatus being broken away in order to more clearly to reveal the nature of the invention.
FIG. 7 is a vertical sectional view similar to FIG. 6 but taken in the vicinity of the other plow component which is employed in connection with the apparatus.
FIG. 8 is a reduced view, partly in plan and partly in horizontal section, showing the turret of the apparatus with its various material agitating and moving adjuncts as employed in connection with the present invention.

Referring now to the drawings in detail and in particular to FIGS. 1 to 4, inclusive, the disclosure of these views constitutes one exemplary form of the material mixing apparatus embodying the present invention although not necessarily the exact commercial embodiment thereof. The apparatus is particularly designed for use in connection with the mixing of lead oxide water and sulphuric acid, together with other possible additives, in the production of battery paste which ultimately is used in the manufacture of automotive and other wet cell battery plates. In this regard throughout this specification, the invention will be described with relation to such use, but it is to be distinctly understood that other uses for the invention are contemplated as, for example, in the mixing of foodstuffs in the production of chocolate or other confections.

Briefly, the apparatus which comprises the present invention involves in its general organization a generally cylindrical mixing bowl 10 within which there is centrally disposed a rotary, unitary, mixing assembly 12, the details of such assembly appearing in FIG. 8 of the drawings. Said assembly 12 embodies a central cylindrical or tubular turret 14 which is concentrically arranged with respect to the bowl, and an upper turret extension 16, the turret and its extension being rotatable about the vertical axis of the bowl. The upper turret extension 16 defines an internal air distributing chamber by means of which air is distributed throughout the mass of material undergoing mixing during rotation of the turret in a manner that will be described in detail presently. The turret 14 and its upper extension 16, considered collectively, define in combination with the side wall of the bowl 10 and the hereinafter described side wall door, and also the bowl bottom wall an annular mixing chamber. The turret 14 serves to support a plurality of generally radially extending material-mixing and agitating components including a first plow component 18 (see FIG. 8), a second plow component 20, a combined shearing cutter and scraper component 22, and an individual cutter component 24. The specific nature and function of these various material-mixing and agitating components will likewise be described in detail subsequently. Although two of the plow components and two of the cutter components are illustrated in the drawings for exemplary or disclosure purposes, it is contemplated that a greater number thereof may be employed if desired. However, regardless of the number of such components which may be employed, the circumferential spacing thereof will always be equal so that, as in the illustrated form of the invention, these components are disposed 90° apart on the periphery of the turret 14 with the plow components being diametrically disposed from each other and the cutter components likewise being disposed in diametric relationship. The apparatus further includes a feed or supply hopper 25 for dry material which is to be treated in the bowl 10 and, where battery paste-mixing operations are concerned, is in the form of granular lead oxide, a supply pipe 26 for introducing water into the bowl for material-moistening and turret wash-down purposes, and a perforated supply manifold 28 by means of which sulphuric acid may be added to the material undergoing treatment in the bowl 10. Means are provided for drawing air through the interior of the bowl, not necessarily for the purpose of aerating the material undergoing mixing but for withdrawing any hot gases or vapors which may be generated by the chemical union which takes place within the bowl, and particularly for withdrawing the resultant heat of formation incident to such chemical union. Accordingly, a suction pipe 30 communicates with the interior of the bowl through a removable bowl cover plate 32, while a circular air inlet opening 33, which is centrally formed in the bowl cover plate and is covered by a screen 34, admits air to the interior of the turret extension 16. The withdrawal of air and other gaseous material, as well as vapors, from the bowl 10 through the suction pipe 30, places the interior of the bowl under subatmospheric pressure, causes air to be drawn from the interior of the tubular turret extension 16 through a series of circumferentially spaced openings 35 which are formed in the cylindrical side wall of the turret extension 16, the cool air entering the bowl through the screen-covered central opening 33 in the bowl cover plate 32 and the heated air and its entrained vapors and gases leaving the bowl through the suction pipe 30. The apparatus is essentially of the batch type which is to say that it is adapted to mix successive batches of the material, the batches being introduced into the bowl by means of the supply hopper 25 for admixture with the liquid materials, i.e., sulphuric acid and water in the case of battery paste-mixing operations, and the mixed material being discharged from the bowl through a rectangular, door-equipped discharge opening 36 (see FIG. 3) which is formed in the cylindrical side wall of the bowl, such opening having associated therewith a hinged door 38 for opening and closing it. Due to the relatively large amount of heat which is generated within the bowl when the latter is used for battery paste-mixing operations, the air-cooling procedure briefly outlined above is augmented by a heretofore used water-cooling arrangement wherein water jackets encompass major portions of the side and bottom walls of the bowl, as well as the hinged door 38, so that cooling water which is caused to flow through such water jackets during the mixing operation assimilates much of the heat of formation by direct heat conduction through the bowl side and bottom walls, all in a manner that will be made clear when the operation of the apparatus is set forth hereafter.

Considering the mixing apparatus of the present invention in greater detail, and still referring to FIGS. 1 to 4, inclusive, the bowl 10 is of a composite nature and embodies a substantially flat, circular bottom wall 40, an upstanding cylindrical side wall 42, and a top wall which is defined or constituted by the aforementioned cover plate 32. Both bottom and side walls 40 and 42 of the bowl area are, as previously stated, water-jacketed, the water jacket 44 for the bottom wall 40 being suitably and permanently secured as by welding to the underneath side of such wall and the water jacket 46 for the cylindrical side wall 42 being similarly permanently secured to the outer side of such wall.

The cylindrical side wall 42 of the bowl 10 is interrupted or cut away to provide the aforementioned discharge opening 36, the water jacket 46 likewise being interrupted to accommodate the hinged door 38 and the latter, which is of arcuate configuration, when closed, affords a continuation of the curved side wall 42. The door 38 is provided with a fixed water jacket 48 which swings with the door between its closed and its open positions.

Figure 2:
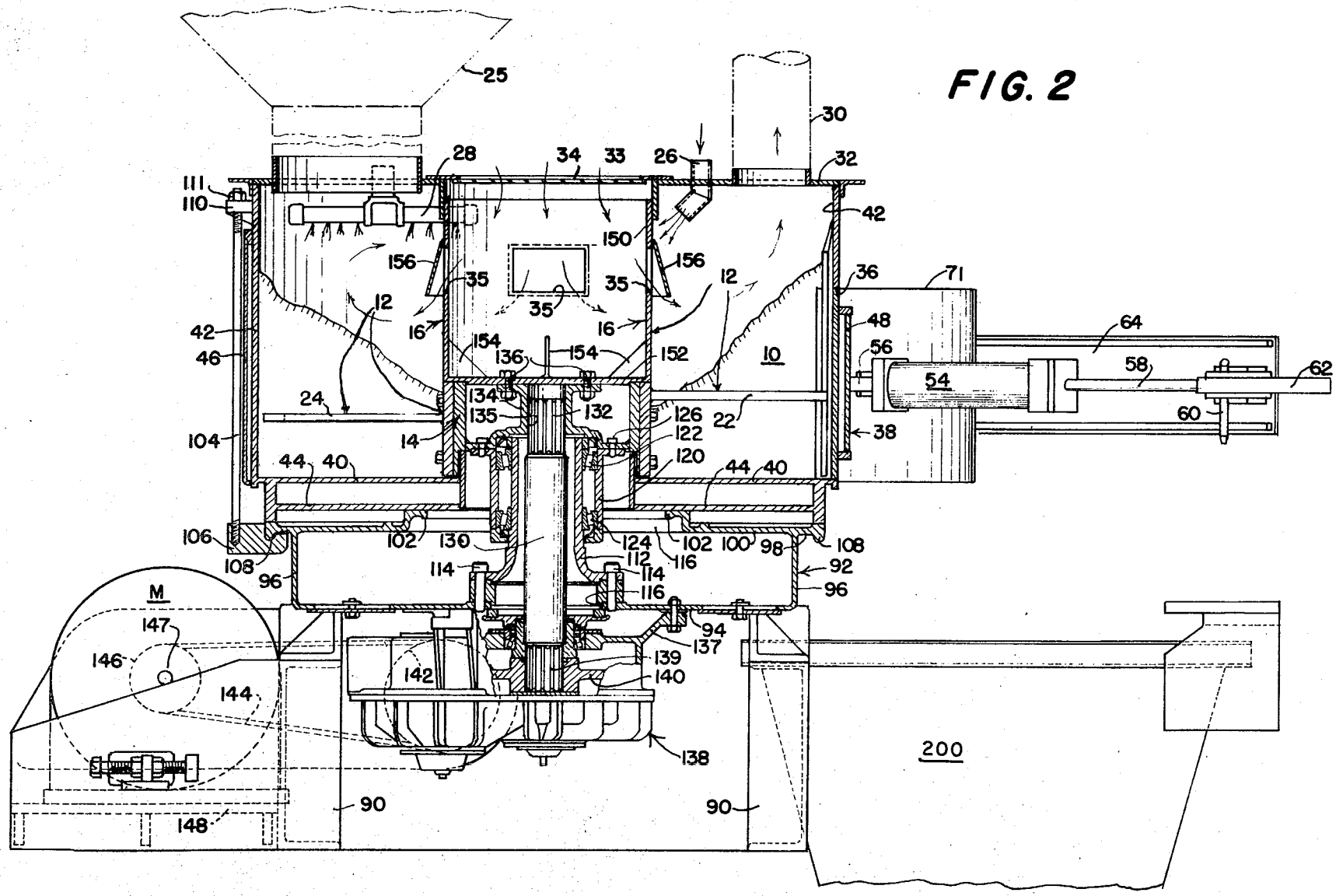
FIG. 2 is a vertical sectional view taken on the line 2—2 of FIG. 1, certain parts being broken away and shown in elevation in the interests of clarity.
Figures 3, 4, 5, 6:
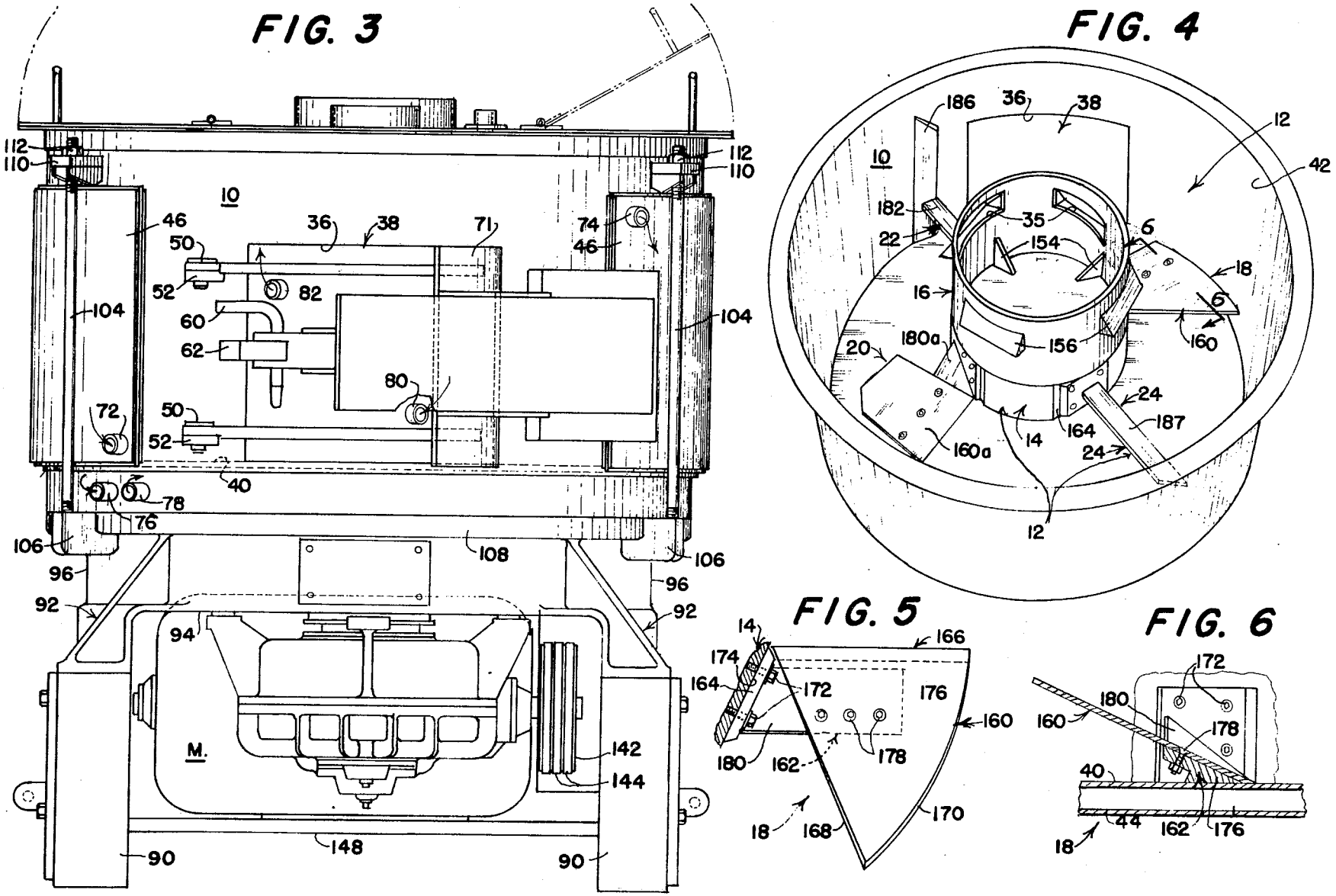
FIG. 3 is a right end side elevational view of the apparatus of FIG. 2 with the supply or feed hopper removed.
FIG. 4 is a top perspective view of the assembly of mixing bowl and rotary turret.
FIG. 5 is an enlarged top plan view, partly in section, the view being taken in the vicinity of one plow component which is employed in connection with the apparatus.
FIG. 6 is a sectional view taken substantially on horizontal plane indicated by the line 6—6 of FIG. 4.

The door structure and the control mechanism by means of which the door 38 is swung between its closed and its open positions are best shown in FIGS. 1, 2 and 3 wherein the door is shown as being hinged by means of vertically extending hinge pins 50 on upper and lower horizontally extending supports 52 and as being movable under the control of a horizontally extending air cylinder 54. The supports 52 are in the form of lugs which are welded to and project outwards from that portion of the bowl side wall that is adjacent to one vertical edge of the material discharge opening 36. The inner end of the cylinder 54 is hingedly connected as indicated at 56 to the outer or distal edge region of the hinged door 38 and the cylinder 54 has associated therewith a rod 58, the inner end of which is provided with a piston (not shown) and the outer end of which extends through the outer end of the cylinder and is connected by a hinge pin 60 to an elongated horizontally extending member 62 which is carried at the outer end of a horizontally extending reaction beam 64. The inner end of the beam 64 is fixedly attached by means of bolts 66 to a mounting bracket 68, the latter being welded or otherwise fixedly secured in position on the side wall of the bowl 10. The member 62 is provided for the purpose of effecting different positions of maximum door opening, and accordingly, it is provided therein with a linear row of holes 70 within which the hinge pin 60 is selectively receivable. The plunger 58 is a substantially full stroke plunger so that in its fully extended position, the door becomes fully and tightly closed as shown in full lines in FIG. 1, while in its fully retracted position, the door will assume a maximum opening which is dependent upon the particular hole 70 which is selected for reception of the hinge pin 60. Thus, for example, when the innermost hole in the series of holes 70 is selected for reception of the hinge pin 60, the maximum door opening which will obtain as a result thereof will be greater than when any of the more remote holes are selected for reception of the hinge pin. By such an arrangement, differences in the rate of batch discharge may be effected.

As best shown in FIG. 1 of the drawings, the aforementioned reaction beam 64 serves to support an arcuate deflector plate 71, the center of curvature of which is coincident with the vertical axis of the hinge pin 50 and the radius of curvature of which is equal to the effective circumferential width or extent of the door 38 so that the distal edge of the latter makes substantial sealing contact with the inner or concave face of the deflector plate 71 during door opening and closing movements and, thus, automatically effects cleaning of such face. Without such door and deflector arrangement the mixed materials would adhere to the inner face of the deflector. The arcuate extent of the deflector plate 71 is such that when the hinge pin 60 is disposed within the innermost hole 70 in the member 62, the maximum door opening will be such that the outer edge of the door 38 will bear against the outer region of the deflector plate 71 as shown in dotted lines in FIG. 1. Thus, at no time is the outer edge of the door 38 capable of running off the outer edge region of the deflector plate.

Still referring to FIGS. 1 and 2, and additionally to FIG. 3, cooling water is respectively supplied to the various water jackets 44, 46 and 48 by means of inlet and outlet nipples 72 and 74 (see FIG. 1) for the bowl wall jacket 46, inlet and outlet nipples 76 and 78 for the bottom wall jacket 44, and inlet and outlet nipples 80 and 82 for the door jacket 48 (see FIG. 3). It will be understood, of course, that the various nipples will be operatively connected to suitable flexible or other conduits (not shown) by means of which cooling water may be conducted from a source or to a region of water discharge, preferably in a closed circuit water cooling system.

The supporting structure for the mixing bowl 10 is best illustrated in FIGS. 1 to 3, inclusive, and embodies a series of four upstanding supporting legs 90 which are arranged in quadrilateral fashion, the upper ends of such legs serving to support thereon a base casting 92 which is of cup-shaped design and has a horizontal annular bottom wall 94 and an upstanding cylindrical side wall 96. The latter is provided with an upper laterally outwardly extending annular rim flange 98 and an inwardly extending annular shelf portion 100 having an upstanding inner seating rib 102. The water jacket 44 which is disposed on the bottom wall 40 of the bowl 10 is supported on the seating rib 102 and on the hereinafter mentioned annular rib and the entire bowl assembly including the bowl proper, its associated water jackets 44 and 46, the door 38 and its adjuncts including the air cylinder 54 and its associated supporting mechanism including the deflector beam 64, is held in position on the base casting 92 by means of a series of three vertically extending clamping rods 104. The lower ends of such rods are threadedly received in hook-like members 106 (see FIG. 2) which engage beneath an annular rib 108 on the underneath side of the laterally extending rim flange 98 on the cup-shaped casting 92. The upper ends of the clamping rods 104 project through hold-down bracket 110 which are secured to and extend outwards from the side wall 42 of the bowl 10 above the level of the water jacket 46. Nuts 111 are threadedly received on the upper ends of the rods 104 and serve, when tightened, to place the rods under tension and thus draw the bowl assembly including its bottom wall and the associated water jacket 44 securely against the cup-shaped casting 92.

The rotary mixing assembly 12 which, as previously stated, embodies the turret 14, the latter's upper extension 16, the first and second plow components 18 and 20, the combined shearing cutter and scraper component 22, and the individual cutter component 24, is rotatably mounted on a vertically extending central hollow pedestal 112 (see FIG. 2), the base portion of which is fixedly secured by vertically extending bolts 114 to the inner peripheral portion of the annular bottom wall 94 of the casting 92. Said base portion of the pedestal 112 registers with the central opening 116 which is defined by such inner periphery of the aforementioned annular bottom wall 94. The rotatable mounting for the mixing assembly 12 includes a turret-supporting hub 120 which is rotatably supported on the upper portion of the pedestal 112 by means of upper and lower combined thrust and roller bearings 122 and 124. The turret 14 is secured to the upper end of the hub 120 by means of vertically extending bolts 126.

The mixing assembly 12 is adapted to be driven in one direction by means of a vertical drive shaft 130 (see FIG. 2) which extends through the central opening 116 in the bottom wall 94 of the cup-shaped casting 92. The upper end of such drive shaft is splined as at 132 in order that it is drivingly connected to the turret extension 16 and, consequently, to the entire rotatable mixing assembly 12. The driving connection of which the splined upper end of the shaft forms a part is in the form of an inverted cup-shaped casting 134 which is bolted to the underneath side of the bottom wall of the turret extension 16 and is formed with an internal splined socket 135 into which said splined upper end of the shaft 130 extends. Nut and bolt assemblies 136 serve further to secure the upper portion of the casting 134 to the underneath side of the bottom wall of the turret extension 16. The lower end of the drive shaft 130 projects downwards through an opening in the top wall of the housing 137 of a gear reduction device 138 terminates within the interior of said housing and is provided with a splined section 139 having mounted thereon a gear 140 which constitutes the output gear of a gear reduction power train (not shown) within the housing 138. The input gear of such power train is driven by a pulley 142 (see FIGS. 2 and 3) which is connected by a multiple endless belt arrangement 144 to a drive pulley 146 on the drive shaft 147 of an electric motor M on a motor platfrm 148, thus completing a power drive from the motor M to the rotatable mixing assembly 12.

Considering now the character of the rotatable mixing assembly 12, and referring particluarly to FIGS. 1, 2 and 4, the turret extension 16 is of relatively deep cup-shaped configuration and is provided with a generally cylindrical wall 150 and a circular bottom wall 152, the bottom region of the turret extension 16 being reinforced by means of triangular webs 154. Louver-like air deflectors 156 are formed on the cylindrical wall 150 of the extension 16 adjacent to the air opening 35 and serve a purpose that will be made clear presently.

Referring now to FIGS. 4, 5 and 8, the character and disposition of the aforementioned four material mixing and agitating components which are carried by the rotary turret 14 constitute one of the principal points of novelty of the present invention, these four components being, namely, the first plow component 18, the second plow component 20, the combined cutter and scraper component 22, and the individual cutter component 24.

The two diametrically disposed, first and second plow components 18 and 20 are generally similar in their construction and, therefore, a description of one of them will suffice for them both. The first plow component 18 is in the form of a two-part assembly including a lift plow 160 (see FIG. 6) which is of planar sheet-like construction and generally triangular in outline, and a plow holder 162 by means of which the lift plow 160 is secured to the turret 14. The turret 14 is provided with a series of four equally and circumferentially spaced flattened surfaces 164 which are best seen in dotted lines in FIG. 1 and in full lines in FIG. 4, two of these flattened surfaces constituting anchor regions for the plow components 18 and 20, and the other two surfaces constituting anchor regions for the components 22 and 24.

As best shown in FIGS. 1, 5 and 8, the generally triangular lift plow 160 of the first plow component 18 is positioned so that it is inclined forwardly and downwardly with respect to the direction of movement of the mixing assembly and is provided with a straight leading edge 166 which extends radially and outwardly of the turret 14, from a point in close proximity to the turret to a point in close proximity to the side wall of the bolt a straight trailing inner edge 168 which extends in an approximately tangential direction with respect to the turret and outwardly from the inner end of the leading edge to a point adjacent to the bowl side wall, and an arcuate outer edge 170 which conforms in curvature to that of the cylindrical side wall 42 of the bowl 10, sweeps around the bowl in close proximity to such wall and has its front end in meeting relation with the outer end of the leading edge 166 and its rear end in meeting relation with the rear end of the straight trailing inner edge 168. The straight leading edge 166 of the lift plow 160 of the first plow component 18 lies close to the bottom wall 40 of the bowl 10 while the rear portion of said lift plow 160 is disposed an appreciable distance above said bottom wall. Since the lift plow is of planar construction, it follows that the arcuate outer edge 170 thereof is generally in the form of an arc of an ellipse where its projection intersects the cylindrical side wall of the bowl 10.

The lift plow 160 of the first plow component is supported on the plow holder 162 and the latter is, in turn, supported on one of the aforementioned flattened surfaces 164 of the turret 14 by means of anchoring bolts 172 (see FIGS. 5 and 6). Such plow holder is comprised of a base portion 174 through which the bolts 172 project, a laterally and outwardly extending shelf portion 176 which underlies the lift plow 160 and to which the latter is bolted by means of fastening bolts 178, and a generally triangular gusset-like web portion 180 which forms in effect a part of the lift plow 160 of the first plow component 18 extends between the proximate or front end region of the straight trailing inner edge 168 of the lift plow 160 and the base portion 174 of the holder 162 and is inclined upwards and inwards with respect to the bowl bottom wall 40 at an angle which is steeper than the forward and downward inclination of the lift plow 160. As clearly shown in FIGS. 5 and 8 of the drawings, the generally triangular gusset-like web portion 180 of the first plow component has its trailing end edge positioned adjacent to the medial portion of the trailing inner edge of the lift plow 160 and in substantially parallel relation with the leading edge of the lift plow and forms a continuous angular surface between the front portion of the lift plow 160 and and the adjacent portion of the turret 14.

The second plow component 20 which includes both the lift plow 160*a* and its associated holder 162*a* is similar to the first plow component 18 and, therefore, in order to avoid needless repetition of description, similar reference numerals but having the suffix *a* applied thereto, have been applied to the corresponding parts of the two plow components as between the disclosures of FIGS. 7 and 6. The lift plow 160*a* of the second plow component 20 is provided with leading and trailing edges 166*a* and 168*a* which correspond directionally to the corresponding edges 166 and 168 of the lift plow 160 of the first plow component 18, although they are of lesser linear extent. The outer edge 170*a* of the lift plow 160*a* is straight and is spaced from the cylindrical wall 42 of the bowl 10 an appreciable distance, the lift plow 160*a* thus being somewhat narrower than the lift plow 160. In addition, the lift plow 160*a* of the second plow component 20 has its trailing end portion truncated instead of pointed as in the case of the lift plow 160 and, consequently, the lift plow 160*a* is somewhat shorter than the lift plow 160 of the plow component 18. As the result of the lift plow 160*a* having its trailing end portion truncated or cut off, in effect, such lift plow has an additional straight trailing edge which is substantially parallel to the leading edge 166*a* and extends substantially at right angles to the trailing edge 168*a*. The plow holder 162*a* for the lift plow 160*a* of the second plow component 20 is substantially the same as the plow holder 162. As best illustrated in FIG. 8, the second plow component 20 has a generally triangular gusset-like web portion 180*a* which corresponds to and functions like the gusset-like web portion 180 of the first plow component 18.

The combined cutter and scraper component 22 consists of a generally radially extending flat elongated cutter blade or element 182 (see FIGS. 1 to 4), the proximate end of which is provided with a rectangular attachment plate 184 (see also FIG. 8) by means of which it is bolted or otherwise fixedly secured to one of the flattened surfaces 164 on the turret 14. The leading edge of the cutter element 182 is relatively sharp throughout its entire length and at the outer end of the element there is provided a vertically extending, elongated, flat, narrow scraper member 186 which extends from a region close to the bottom wall 40 if the bowl 10 upwardly to a region which lies slightly above the level of the material within the bowl which is undergoing mixing. The plane of this scraper member is inclined forwardly and outwardly of the leading direction of movement of the mixing assembly 12 and the leading edge thereof lies close to the cylindrical wall 42 of the bowl 10.

The individual cutter component 24 is similar to the cutter element 182 but the outer or distal end of such element is devoid of a scraper member like the member 186. The individual cutter component 24 is supported from one of the four flattened surfaces 164 of the turret 14 by means of an attachment plate 188 which is similar to the attachment plate 184 for the cutter element 182 of the combined cutter and scraper component 22. It is to be noted at this point that the two components 22 and 24 extend generally radially and horizontally outwardly from the turret 14 at diametrically spaced regions, the combined cutter and scraper component 22 being disposed at an elevation which lies appreciably above the elevation of the individual cutter component 22 and shown in FIG. 2 of the drawings.

In the operation of the herein described material mixing apparatus, when the same is employed for mixing dry lead oxide with sulphuric acid and water in the production of battery paste, batch operation of the apparatus may be accomplished by initially energizing the motor M so as to commence rotation of the mixing assembly 12 while at the same time causing water to be introduced into the bowl 10 through the supply pipe 26. Shortly after the flow of water has commenced, a predetermined batch volume of the dry lead oxide which previously has been placed in the supply hopper 25 is caused to enter the bowl for admixture with the water. As soon as the predetermined quantity of water has entered the bowl, the supply thereof is terminated and mixing operations are continued for a short period of time in order to insure uniformity of moisture throughout the entire batch of materials undergoing mixing.

It is to be noted at this time that the water which is introduced into the bowl from the supply pipe 26 is directed at an angle (downwards and inwards) as shown in FIG. 2 against the upper region of the rotating turret extension 16. An appreciable portion of such water thus flows downwardly alongside the rotating turret, thereby washing down the latter, the louver-type deflectors 156 serving to shield the air outlet openings 35 against the entrance of water into the interior of the turret extension. A considerable portion of the water which contacts the turret extension will, however, be flung radially outwardly into the mixing annulus which exists between the turret and its extension and the side wall of the bowl. This water also washed the plow components 18 and 20, as well as the side and bottom walls of the bowl. As the water continues to drench the turret extension and flow downwardly over the outside thereof, such water, together with whatever oxide material it may collect by entrainment, is scooped upwardly by the relatively small triangular webs 180 and 180*a* which bridge the distance between the inner regions of the lift plows 160 and 160*a* and the adjacent turret 14. Such water and its entrained oxide material is discharged over the trailing edges of the webs 180 and 180*a* into the voids which are created incident to the scooping of the oxide material from the bottom region of the bowl 10 by the lift plows 160 and 160*a*, upwardly and over the elevated trailing inner edges of such lift plows. Thus, as the entire mixing assembly 12 continues to rotate, solid and liquid materials are elevated from the bottom region of the bowl 10 with the small triangular webs 180 and 180*a* serving to divide portions of the materials and direct them under the material that emanates from the trailing edges 168 and 168*a* of the lift plows 160 and 160*a* and into the voids behind the lift plows, the dividing and recombining operation progressing continuously until uniformity of materials undergoing mixing is attained.

As soon as such uniformity of moisture content is attained, the predetermined quantity of sulphuric acid commensurate with the size of the batch undergoing mixing is admitted to the bowl interior through the perforated supply manifold 28. This acid flows uniformly from the small openings or perforations in the bottom portion of such manifold over the surface of the circumferentially progressing material within the bowl and, because of the fact that at the time which such acid is admitted to the bowl, all dry areas or spots within the material have been dissipated, there is no danger of the creation of the aforementioned indestructible hard lumps of solidified material, the sulphuric acid blending uniformly into the moist material undergoing mixing. When the predetermined quantity of sulphuric acid has been incorporated in the mixture, the acid supply is terminated and a short time of mixing operation is continued in the interests of attaining complete mixture uniformity in the finished product or battery paste.

The time at which subatmospheric pressure is applied to the bowl during the mixing operation is not critical except for the fact that air should be drawn from the bowl through the suction pipe 30 no later than the time at which the sulphuric acid is added by way of the perforated supply manifold 28 to the mixture within the bowl. If desired, such air suction may be initiated at the time the electric motor M is initially energized and it may be continued throughout the entire mixing cycle. Since the purpose of air withdrawal from the bowl is to augment the cooling action afforded by the various water jackets 44, 46 and 48, and also to remove entrained gases and vapors from the upper region of the bowl, it is not necessary to resort to such air withdrawal until such heat, gases, and vapors have been generated incident to the application of sulphuric acid to the mixture. During the mixing cycle, air is maintained in the cylinder 54 so as to maintain the hinged or pivoted door 38 in its closed position.

Inasmuch as it is necessary effectively to seal the interior of the mixing annulus against the admission of ambient air thereinto except through the openings 35 in the side wall of the turret extension 16, suitable means must be provided for sealing off the lower end of the hopper 25 after the dry lead oxide batch has been discharged into the mixing annulus. Accordingly, the hopper 25 may be provided with conventional sealing means (not shown) for accomplishing this purpose. One such means is in the form of a rubber bladder-type mechanism which is manufactured and sold by Vibra-Screw, Inc. of Totowa, New Jersey under the trade name "Varigate". Inasmuch as such hopper-sealing mechanism constitutes no part of the present invention, it has not been illustrated herein and, furthermore, various other commercially available hopper-sealing devices are available for use in connection with the present invention.

Discharge of the mixed batch is accomplished by the simple expedient of causing air to be applied to the air cylinder 54 in such a manner as to retract the plunger 58, it being understood, of course, that, during the mixing cycle, air is maintained on the cylinder in a direction to extend the plunger 58 and thus force the water-cooled door 38 to its closed position across the discharge opening 36 as heretofore indicated. As previously stated, the extent of maximum door opening may be regulated by positioning the hinge pin 60 for the distal end of the plunger 58 in the appropriate hole 70 in the member 62. The door opening process is carried out while the mixing assembly 12 continues to rotate so that the lift plows 160 and 160*a* of the components 22 and 24 continue to elevate the material which has been mixed to approximately slightly above the uppermost level of the discharge opening 36. The rotation of these lift plows 160 and 160*a*, as well as of the cutter component 24 and the combined cutter and scraper component 22 imparts a certain degree of outward movement of the material with which they come into contact, thereby forcing such material outwardly through the door-equipped discharge opening 36, such outward movement of the material being augmented by centrifugal force due to the circumferential movement of the material. The material leaving the discharge opening 36 encounters the arcuate deflector 71 from whence it falls by gravity into a suitable receptacle such as a hopper-type feeder 200 which may be positioned to receive the material beneath said deflector.

In connection with the operation of the door 38, it is to be noted that after a given batch of the material has been discharged from the bowl 10 in the manner previously described, closure of the door preparatory to the mixing of a succeeding batch will cause the outer vertical edge of the door to sweep across the arcuate surface of the door deflector 71 and cause such material as may have adhered to the latter to be swept, so to speak, back into the bowl 10 through the door opening 26 or to drop by gravity into the subjacent hopper-type feeder 200.

The invention is not to be limited to the exact arrangement of parts shown in the accompanying drawings or described in this specification as various changes in the details of construction may be resorted to without departing from the spirit or scope of the invention. Neither is the invention to be limited to the precise mode of operation which has been set forth herein, such operation being predicated upon the use of the mixing apparatus in the production of battery paste. For example, where the materials undergoing mixing have no chemical reaction and merely produce a blend or mixture rather than a compound, especially where heat is not generated, the novel lift plow action herein set forth will still obtain to insure an intimate blend of the dry and liquid materials, but either the water or air-cooling steps or mechanisms, or both, may be omitted from the mixing apparatus or they may be disabled. Under certain circumstances as, for example, in the mixing of confections for the production of a candy bar ingredient, the water jackets 44, 46 and 48 may be employed for heating purposes. Similarly, where, for example, chocolate constitutes the principal ingredient of the mixed confection, the dry powdered chocolate may be introduced into the bowl by way of the hopper 25, while either or both of the supply pipes 26 and 28 may be employed for the introduction of water, milk, flavoring material, or the like. Therefore, only insofar as the invention is particularly pointed out in the accompanying claims is the same to be limited.

Having just described the invention, what we claim as new and desire to secure by Letters Patent is:

1. An apparatus adapted to mix intimately a solid material with a liquid to produce a homogeneous substance and comprising:

a. an upright bowl designed for reception of the solid material and the liquid and including a horizontal bottom wall and an upstanding cylindrical side wall, b. a mixing assembly mounted for rotation in one direction about a central vertical axis within the bowl, said assembly comprising a generally cylindrical turret defining with said side and bottom walls of the bowl a mixing annulus, c. a plow component fixedly mounted on and rotatable with said turret in the lower region of said annulus and comprising a planar generally triangular scoop-like lift plow positioned so that it is inclined forwardly and downwardly with respect to the direction of rotation of the turret and having a straight horizontal leading edge which is disposed in close proximity to said bottom wall and extends radially and outwardly of the turret from a point in close proximity to the turret to a point in close proximity to the side wall of the bowl, a straight trailing inner edge which extends generally in tangential fashion with respect to the turret and also upwardly and outwardly from the inner end of the leading edge to a point adjacent to said side wall, and an outer arcuate edge which conforms in curvature to that of the cylindrical side wall of the bowl, coextensively hugs the inner surface of said side wall of the bowl, and has its front end in meeting relation with the outer end of said leading edge and its rear end in meeting relation with the rear end of said trailing inner edge, said plow component also comprising a planar triangular gusset-like web which is shaped conformably to and arranged fully to bridge the space between the front end region of said trailing inner edge of the lift plow and the adjacent portion of the turret, is inclined upwardly and inwardly with respect to said front end region of the trailing inner edge of the lift plow, and has its trailing end edge positioned adjacent to the medial portion of said trailing inner edge of the lift plow and in substantially parallel relation with the leading edge of the lift plow, the angle of upward and inward inclination of said web being greater than the angle of forward and downward inclination of the lift plow, d. means for directing a stream of the liquid into said annulus in the upper region thereof for admixture with the solid material in the bowl and also against the turret for wash-down purposes, e. said lift plow of the component being effective upon rotation of the turret to deflect the solid material and liquid on the bottom wall of the bowl upwardly and over the upper surface of such lift plow and to discharge the same over said trailing inner edge, thus producing a void behind the lift plow, and said web of the plow component forming a continuous angular surface between the front portion of the lift plow and said adjacent portion of the turret and being effective due to its shape, length, and angle of inclination to receive a portion of the liquid that flows down the turret and also a part of the solid material that is deflected upwards by the lift plow and to discharge the same under the solid material emanating from the trailing inner edge of the lift plow and into said void, thus resulting in a continuous division and recombination of the solid material within the annulus during rotation of the turret, and f. power means for rotating said turret in said one direction.

2. A mixing apparatus as set forth in claim 1 and including, additionally, a second plow component fixedly mounted on and rotatable with the turret in the lower region of the annulus, circumferentially spaced with respect to the first mentioned plow component, and comprising a scoop-like lift plow which is inclined forwardly and downwardly with respect to the direction of movement of the turret, differs from the lift plow of the first mentioned plow component in both size and shape, and has leading and trailing edges which are directionally similar with respect to the turret as the leading and trailing edges of the lift plow of said first mentioned plow component, and a planar triangular gusset-like web which is shaped conformably to and is arranged fully to bridge the space between the front end region of the trailing edge of the lift plow of the second plow component and the adjacent portion of the turret, has its trailing end positioned adjacent to the medial portion of the last mentioned trailing edge and in substantially parallel relation with the last mentioned leading edge, forms a continuous angular surface between the front portion of the lift plow of the second plow component and said adjacent portion of the turret, and functions similarly to the gusset-like web of the first mentioned plow component.

3. A mixing apparatus as set forth in claim 2 and wherein the radial extent of the leading edge of the lift plow of the second plow component is appreciably less than that of the leading edge of the lift plow of the first mentioned plow component, the linear extent of the trailing inner edge of the lift plow of the second plow component is appreciably less than that of the trailing inner edge of the lift plow of said first mentioned plow component, and the over-all radial extent of the lift plow of the second plow component is less than the radial extent of the annulus.

4. A mixing apparatus as set forth in claim 3 and wherein the rear portion of said lift plow of the second plow component is truncated in such manner that it embodies an additional straight trailing edge which is substantially parallel to its leading edge and extends substantially at a right angle to its trailing inner edge.

5. A mixing apparatus as set forth in claim 4 and wherein the lift plow of said second plow component is provided with a straight outer edge which is inwardly removed from the side wall of the bowl.

6. In a mixing apparatus of the type that embodies a bowl including a bottom wall and an upstanding cylindrical side wall and adapted to receive a batch of the material to be mixed, a turret mounted for rotation in one direction about a central vertical axis within the bowl and defining with said side wall and bottom walls a mixing annulus, and power means for rotating said turret in one direction, the improvement which comprises; a plow component fixedly mounted on and rotatable with said turret in the lower region of said annulus and comprising a generally triangular planar scoop-like lift plow positioned so that it is inclined forwardly and downwardly with respect to the direction of rotation of the turret and having a straight horizontal leading edge which is disposed in close proximity to said bottom wall and extends radially outwardly of the turret from a point in close proximity to the turret to a point in close proximity to the side wall of the bowl, a straight trailing inner edge which extends generally in tangential fashion with respect to the turret and also upwardly and outwardly from the inner end of the leading edge to a point adjacent to said side wall, and an arcuate outer edge which conforms in curvature to that of the cylindrical side wall of the bowl, coextensively hugs the inner surface of the bowl side wall, and has its front end in meeting relation with the outer end of said leading edge and its rear end in meeting relation with the rear end of said trailing inner edge, said plow component also comprising a planar triangular gusset-like web which is shaped conformably to and arranged fully to bridge the space between the front end region of said trailing inner edge of the lift plow and the adjacent portion of the turret, is inclined upwardly and inwardly with respect to said leading front edge region of the trailing inner edge of the lift plow, and has its trailing edge positioned adjacent to the medial portion of said trailing inner edge of the lift plow and in substantially parallel relation with the leading edge of the lift plow, the angle of upward and inward inclination of said web being greater than the angle of forward and downward inclination of the lift plow, said lift plow of the plow component being effective during rotation of the turret to deflect the material on the bottom wall of the bowl upwardly and over the upper surface of such lift plow and to discharge the same over said trailing inner edge, thus producing a void behind the lift plow, and said web forming a continuous angular surface between the front portion of the lift plow and said adjacent portion of the turret and being effective due to its shape, length, and angle of inclination to receive a part of the material that is deflected upwards by the lift plow and to discharge it into said void, thus resulting in a continuous division and recombination of the material within the annulus as the turret is rotated.

7. In a mixing apparatus, the improvement set forth in claim 6 and including, additionally, a second plow component fixedly mounted on and rotatable with the turret in the lower region of the annulus, and comprising a scoop-like lift plow which is inclined forwardly and downwardly with respect to the direction of movement of the turret, differs from the lift plow of the first mentioned plow component in both size and shape, and has leading and trailing edges which are directionally similar with respect to the turret as the leading and trailing edges of the lift plow of the first mentioned plow component, and a planar triangular gusset-like web which is shaped conformably to and is arranged fully to bridge the space between the front end region of the trailing edge of the lift plow of the second plow component and the adjacent portion of the turret has its trailing end positioned adjacent to the medial portion of the last mentioned trailing edge and in substantially parallel relation with the last mentioned leading edge, forms a continuous angular surface between the front portion of the lift plow of the second plow component and said adjacent portion of the turret, and functions similarly to the gusset-like web of the first mentioned plow component.

8. In a mixing apparatus, the improvement set forth in claim 7 and wherein the radial extent of the leading edge of the lift plow of the second plow component is appreciably less than that of the leading edge of the lift plow of the first mentioned plow component, the linear extent of the trailing inner edge of the lift plow of the second plow component is appreciably less than that of the trailing inner edge of the lift plow of said first mentioned plow component, and the over-all radial extent of the lift plow of the second plow component is less than the radial extent of the annulus.

9. In a mixing apparatus, the improvement set forth in claim 8 and the wherein the rear portion of said lift plow of the second plow component is truncated in such manner that it embodies an additional straight trailing edge which is substantially parallel to its leading edge and extends substantially at right angles to its trailing inner edge.

10. In a mixing apparatus, the improvement set forth in claim 9 and wherein the lift plow of said second plow component is provided with a straight outer edge which is inwardly removed from the side wall of the bowl.

11. In a mixing apparatus of the type that embodies a bowl adapted to receive therein material to be mixed and including a bottom wall and an upstanding cylindrical side wall, a turret mounted for rotation in one direction about a vertical central axis within the bowl and defining with said side and bottom walls a mixing annulus, and power means for rotating said turret in said one direction, the improvement which comprises: a plow component fixedly connected to and disposed outwardly of the turret for rotation bodily in unison therewith for sweeping movement around the annulus, said plow component having an upper planar surface which is inclined forwards and downwards with respect to the direction of travel of the turret, has a leading edge in close proximity to the bowl bottom wall and an elevated trailing edge, and is adapted upon swinging movement of the plow component around said annulus to lift that portion of the material that is adjacent to the bottom region of the bowl and then release the same over said trailing edge so as to form a void behind said trailing edge, said plow component having an additional gusset-like planar surface which is positioned so that it bridges the space between the front region of the inner marginal portion of the first mentioned planar surface and the adjacent portion of the turret, extends upwards and inwards, intersects the turret at a dihedral angle and also intersects said first mentioned inclined planar surface at a dihedral angle, has its trailing end positioned adjacent to the medial portion of said inner marginal portion of the first mentioned planar surface and in substantially parallel relation with the leading edge of the lift plow, and is adapted to elevate that portion of the material that is in the vicinity of the turret and to pass the same beneath the material issuing from the trailing edge of the first mentioned inclined surface and into said void, thus providing a continuous division and recombination of the material within the annulus as the turret is rotated.

12. A plow component designed for use in a mixing apparatus of the type that embodies a bowl adapted to receive therein material to be mixed and including a bottom wall and an upstanding cylindrical side wall, a turret mounted for rotation in one direction about a vertical central axis within the bowl and defining with said side and bottom walls a mixing annulus, and power means for rotating said turret in said one direction, said plow component being provided with means for fixedly connecting it to the turret so that it is rotatable bodily therewith for sweeping movement around the annulus and embodying an upper planar surface which is adapted to assume a downwardly and forwardly inclined position with respect to the direction of rotation of the turret, has a leading edge adapted to lie in close proximity to the bottom wall of the bowl and, in addition, an elevated trailing edge, and is adapted upon swinging movement of the plow component around said annulus to lift that portion of the material that is on the bottom wall of the bowl and then to release the same over its trailing edge so as to form a void behind said trailing edge, said plow component also embodying an additional planar surface which extends upwards and inwards from the front region of the inner side marginal portion of the first mentioned planar surface, is adapted to bridge and fully occupy the space between said front region of the inner side marginal portion of said first mentioned planar surface and the adjacent portion of the turret, intersects the first mentioned inclined planar surface at a dihedral angle, has its trailing end positioned adjacent to the medial portion of said inner marginal portion of the first mentioned planar surface and in parallel relation with the leading edge of the lift plow, and is adapted to elevate that portion of the material that is in the vicinity of the turret and pass the same beneath the material issuing from the trailing edge of the first mentioned inclined planar surface and into said void, thus producing a continuous division and recombination of the material within the annulus as the turret is rotated.

* * * * *